US005249319A

United States Patent [19]

Higgs

[11] Patent Number: 5,249,319

[45] Date of Patent: Oct. 5, 1993

[54] LOW AIR LOSS, PRESSURE RELIEVING MATTRESS SYSTEM

[75] Inventor: Leonard C. Higgs, Hesperia, Calif.

[73] Assignee: Mellen Air Manufacturing, Inc., Long Beach, Calif.

[21] Appl. No.: 942,747

[22] Filed: Sep. 9, 1992

[51] Int. Cl.[5] ..... A47C 27/08

[52] U.S. Cl. ..... 5/453; 5/449; 5/457

[58] Field of Search ..... 5/449, 453–457, 5/469

[56] References Cited

U.S. PATENT DOCUMENTS

| | | | |
|---|---|---|---|
| 388,037 | 8/1888 | Hargin | 5/454 |
| 4,306,322 | 12/1981 | Young et al. | 5/449 |
| 4,394,784 | 7/1983 | Swenson et al. | 5/453 |
| 4,488,322 | 12/1984 | Hunt et al. | 5/453 |
| 4,644,597 | 2/1987 | Walker | 5/449 |
| 4,803,744 | 2/1989 | Peck et al. | 5/453 |
| 4,862,533 | 9/1989 | Adams | 5/454 X |
| 4,873,737 | 10/1989 | Savenije | 5/453 |
| 4,977,633 | 12/1990 | Chaffee | 5/453 |
| 5,022,110 | 7/1991 | Stroh | 5/455 |
| 5,068,933 | 12/1991 | Sexton | 5/453 X |

*Primary Examiner*—Michael F. Trettel
*Attorney, Agent, or Firm*—Hawes & Fischer

[57] ABSTRACT

A compact, fully self-contained low air loss, pressure relieving mattress system for use in supporting individuals at home or in a hospital or health care environment. The system includes a foam mattress having a hollow interior in which to receive an inflatable air plenum and a blower housing. A blower for exhausting air to the plenum and a variable speed motor for driving the blower are located within the blower housing. A pressure control knob is disposed on a manually accessible control panel at the blower housing to permit selective control of the speed of the motor and the rate at which air is exhausted by the blower for inflating the plenum according to the needs of the individual.

18 Claims, 4 Drawing Sheets

LOW AIR LOSS, PRESSURE RELIEVING MATTRESS SYSTEM

BACKGROUND OF THE INVENTION

1. Field of the Invention

This invention relates to an efficient, compact and fully self-contained low air loss, pressure relieving mattress system, the comfort (i.e. pressure) of which may be selectively controlled according to the needs of the user. The disclosed low air loss mattress system is an improvement over the conventional low air loss mattress systems commonly used in hospital and similar health care facilities.

2. Background Art

Conventional mattresses that are used in health care facilities to support an individual are usually constructed with hard plastic covers, thick filler material and springs. Eventually the mattress will compress under the weight of the individual such that the individual is exposed to high pressures at the interface between his skin and the mattress. The hardness of the mattress is of particular concern to an immobile or incoherent individual whose ability to move in bed is largely restricted. In these cases, subcutaneous blood carrying lumens may become occluded, whereby to subject the individual to possible tissue necrosis, or what is commonly known as pressure and bed sores. As a consequence of the foregoing, the individual's hospital stay may be prolonged and the cost of medical treatment correspondingly increased.

One solution to the aforementioned problem and an alternative to the relatively hard hospital mattress is a low air loss mattress. More particularly, a plurality of air sacs are inflated and air is permitted to leak out through small holes in the sacs. While a low air loss mattress system has been found to be therapeutic to a bed ridden individual, the conventional system is very expensive to make and inefficient to operate. That is, an individual is supported on the mattress system by means of continuous air flow to the air sacs from a continuously operating blower. The system typically includes a manifold, external pressure adjusting valves and knobs to control the airflow, and a free standing blower. Thus, the conventional low air loss mattress system is large and bulky, requires time consuming assembly and frequent servicing, and is not convenient for transport or storage.

SUMMARY OF THE INVENTION

In general terms, an efficient, low air loss, pressure relieving mattress system is disclosed for use at home and in hospitals or similar health care facilities. The low air loss mattress system comprises a mattress having a hollow compartment at the interior thereof. At one end of the hollow compartment is an inflatable air plenum formed by a series of air chambers that are filled with air to provide a controlled support for the individual. At the other end of the hollow compartment is a blower housing. A blower is located within the housing and coupled to the air plenum for exhausting air into the air chambers thereof so as to inflate the mattress. A variable speed electric motor is also located in the blower housing for driving the blower. A control panel is located at one end of the blower housing, and an adjustable control knob is disposed at the control panel. The control panel of the blower housing is manually accessible through a window formed in the mattress. The pressure control knob is electrically connected to the motor to control the speed thereof and selectively vary the rate at which air is exhausted by the blower into the air plenum according to the needs of the individual. The disclosed low air loss mattress system is compact, fully self-contained, and requires no feedthrough external electrical connections or air tubes so as to be easy to use, transport and store.

DETAILED DESCRIPTION OF THE PREFERRED EMBODIMENT

Figure 1:
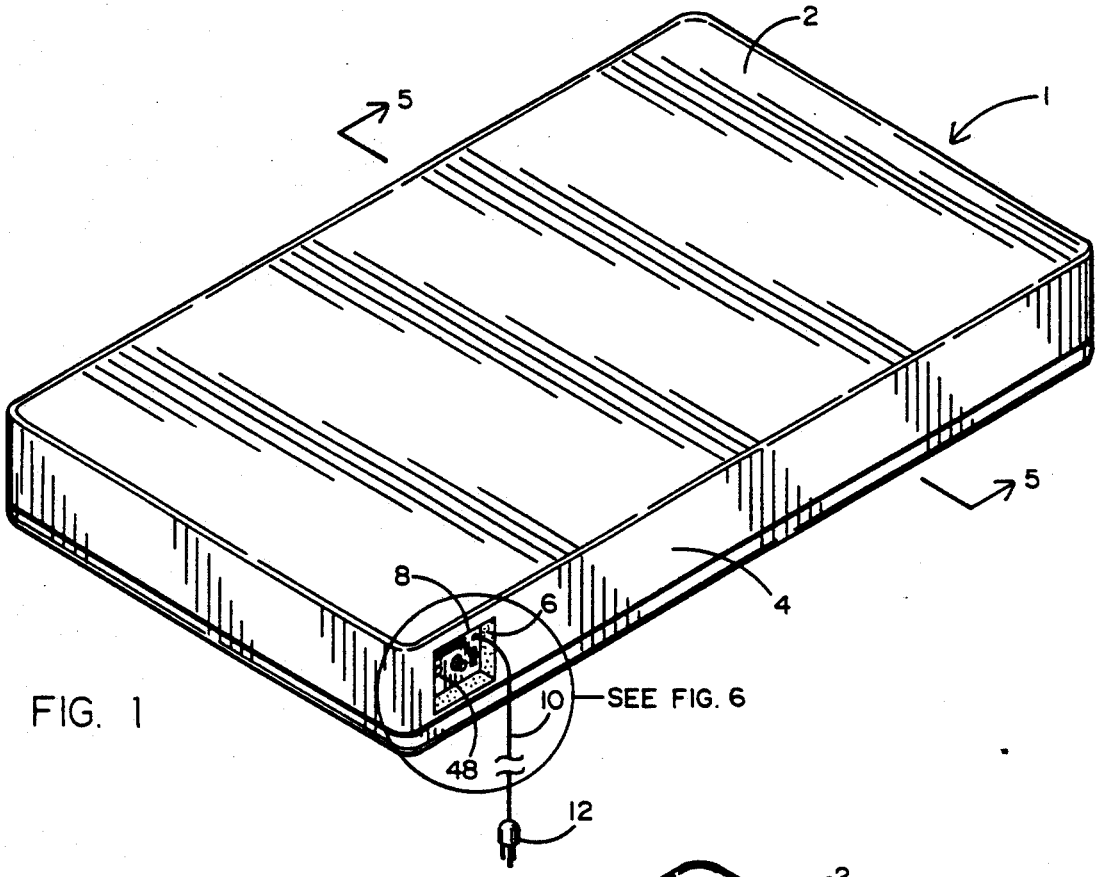
FIG. 1 is a perspective view of the low air loss mattress system which forms the present invention showing a liner surrounding the system.
Figure 2:
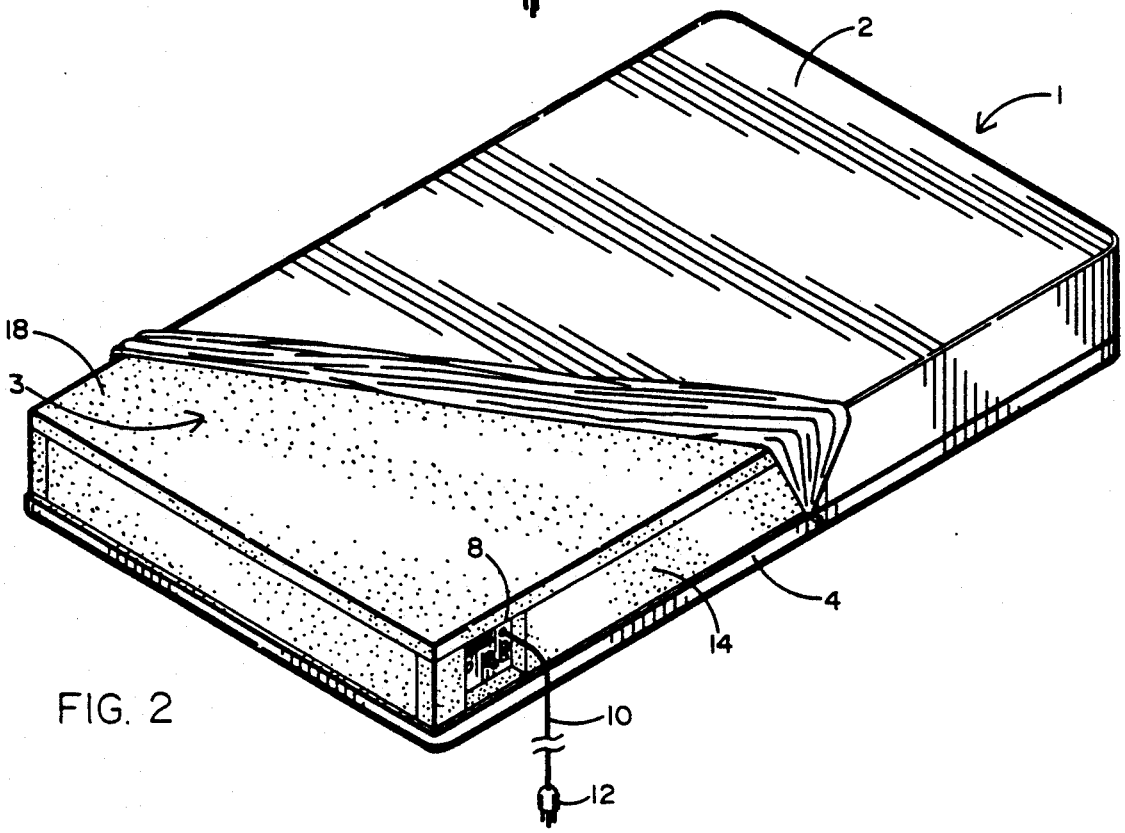
FIG. 2 shows the low air loss mattress system of FIG. 1 with the liner partially removed.

The low air loss pressure relieving mattress system I which forms the present invention is now disclosed in detail while referring to the drawings, where FIGS. 1 and 2 show a mattress 3 surrounded by a removable, tear resistent outer liner 2. A standard zipper 4 extends around the liner to permit liner 2 to be easily removed from or returned to the mattress. The liner 2 is preferably formed from urethane coated nylon that is waterproof, vapor permeable, breathable and anti-bacterial so as to be suitable for use in a health care environment. Pairs of tie strips (designated 15 and best shown in FIG. 5) are affixed to the liner 2 for releasably attaching mattress system 1 to a bed (not shown) so that the system will conform to the posture of the bed when raised or lowered.

Located below liner 2 are flat sheets of soft foam material which are assembled (e.g. cemented) together to form the mattress 3 having a hollow compartment 22 at the interior thereof for receiving a blower housing (designated 24 in FIG. 3) and an inflatable air chamber or plenum (designated 28 in FIG. 3). Axially aligned windows 6 and 8 are cut through the liner 2 and a side rail 14 of mattress 3 to allow the health care worker or care giver access to a control panel 48 that is located on the blower housing 24. Details of control panel 48 will be described hereinafter when referring to FIG. 6. A power cord 10, having a hospital grade plug 12 at one end thereof, extends outwardly from the control panel 48 of blower housing 24 to be removably connected to an available AC power receptacle so as to provide electrical power to the motor of a soon to be described blower (designated 50 and 52 in FIG. 7).

Figure 3:
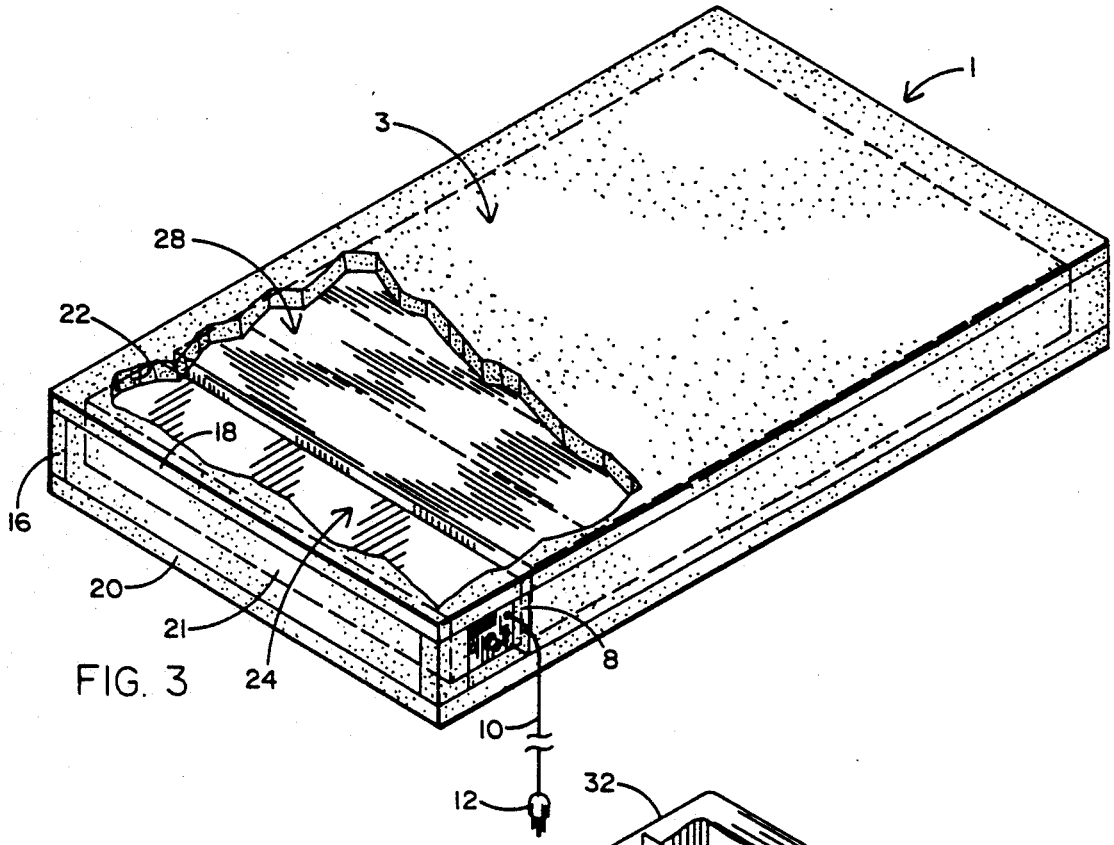
FIG. 3 is a partial broken away view showing a hollow compartment at the interior of the mattress system in which a blower housing and an air plenum are located.

Referring now to FIG. 3 of the drawings, the mattress system 1 is shown with the outer liner 2 removed. The mattress 3 of system 1 includes a pair of opposing side rails 14 and 16, a top patient support surface 18, and a bottom or base 20. Front and rear end panels (only one of which 21 being shown) complete the mattress enclosure. Each of the side rails 14 and 16, top 18 and base 20 of mattress 3 is preferably manufactured from an open cell foam material. By way of example, the side rails 14 and 16 of mattress 3 are manufactured from a medium density (e.g. approximately 1.9 lbs/cu. ft.) polyurethane foam that is characterized by a high recovery rate and a firmness rating of about 28 and available from Future Foam of Fullerton, Calif. The top support surface 18 is a soft, porous polyurethane foam known commercially as Ultracel and manufactured by Crain Industries of Compton, Calif. The base 20 is a high density polyurethane foam that is UL recognized and fire retardant and manufactured by Foamex of San Bernardino, Calif. The front end panel 21 is manufactured from the same foam material as base 20, and the rear end panel (not shown) is manufactured from the same foam material as side rails 14 and 16. While mattress 3 is preferably formed with separate, adhesively connected side rails 14 and 16, top and base layers 18 and 20, and front and rear end panels 21, this is not to be regarded as a limitation of the present invention, and mattress 3 may also be manufactured from a continuous piece of foam having integral sides, top, base and ends with hollow compartment 22 formed therebetween.

Figure 4:
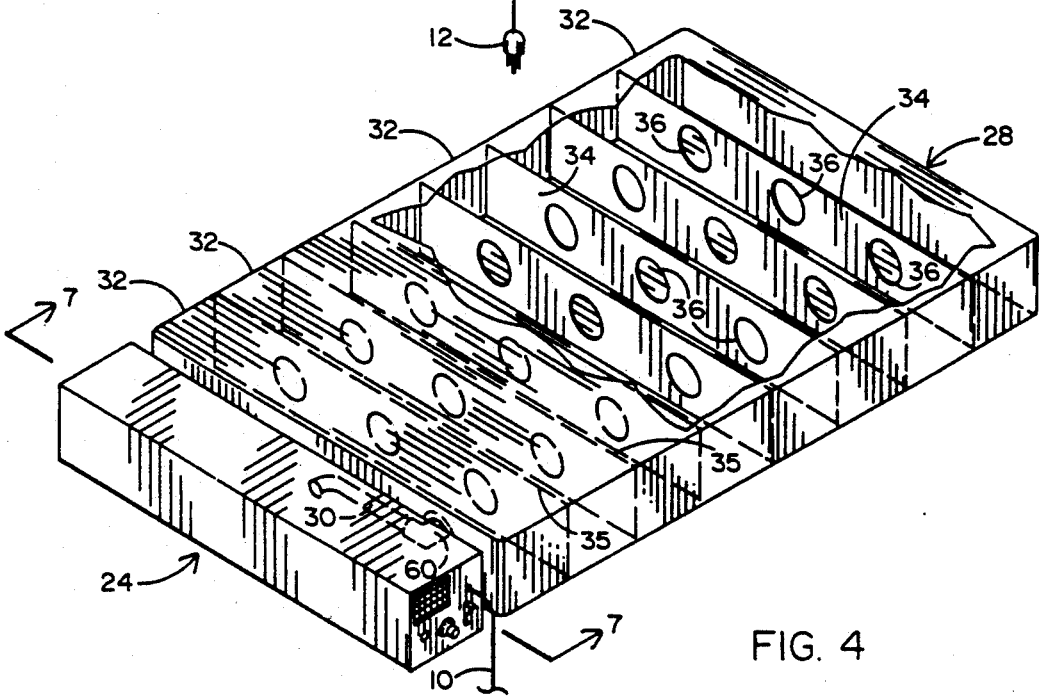
FIG. 4 is a detailed illustration of the blower compartment and air plenum of FIG. 3.
Figure 7:
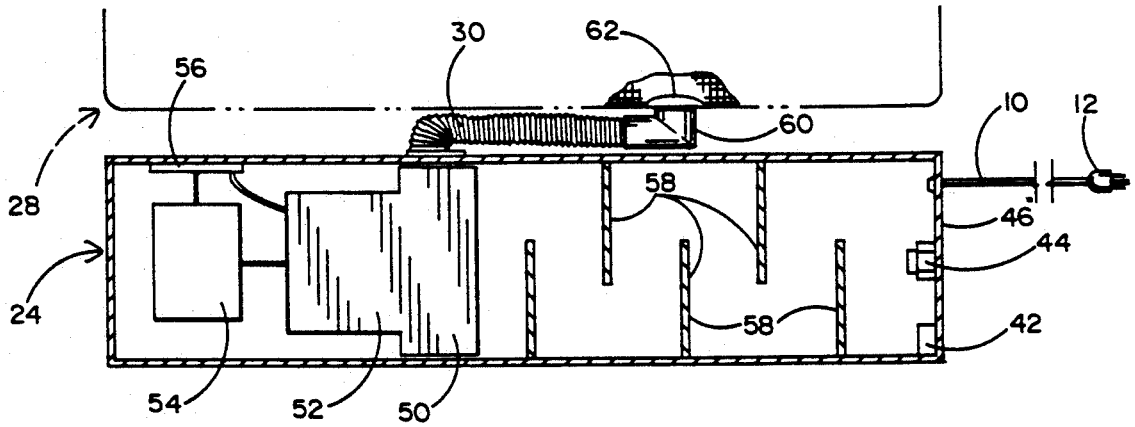
FIG. 7 is a cross-section taken along lines 7—7 of FIG. 4.

Located within the hollow compartment 22 at the interior of mattress 3 is a blower housing 24 (best shown in FIGS. 4 and 7). The blower housing 24 extends across the width of mattress 3 between side rails 14 and 16 so that the control panel 48 of housing 24 is accessible through the window 8 in side rail 14. Located adjacent blower housing 24 in compartment 22 is an inflatable air chamber or plenum 28. In a preferred embodiment of the invention, hollow compartment 22 extends throughout the interior of system 1 so as to be occupied by the blower housing 24 and air plenum 28.

In this regard, FIG. 4 of the drawing shows the blower housing 24 and air plenum 28 with an air tube 30 extending therebetween so that the normally uninflated air plenum 28 may be filled with air in a manner to be disclosed when referring to FIG. 7. The air plenum 28 is preferably manufactured from polyurethane coated nylon and has a plurality of (e.g. twelve) identical air chambers 32 that are serially connected together (only seven of which being illustrated for convenience). More particularly, the air chambers 32 are separated from one another by end walls 34 that are secured to the plenum 28 by means of stitching 35. Each of the end walls 34 has an array of air holes 36 formed therein to permit air to pass from one air chamber 32 to the next so that each of said chambers will be filled with a uniform volume of air. As a preferred embodiment of the invention, it is desirable that the air chambers 32 of plenum 28 be capable of continuously leaking a small volume of air to the atmosphere. Such leakage may be achieved through the stitching 35 that secures end walls 34 to air plenum 28.

Figure 5:
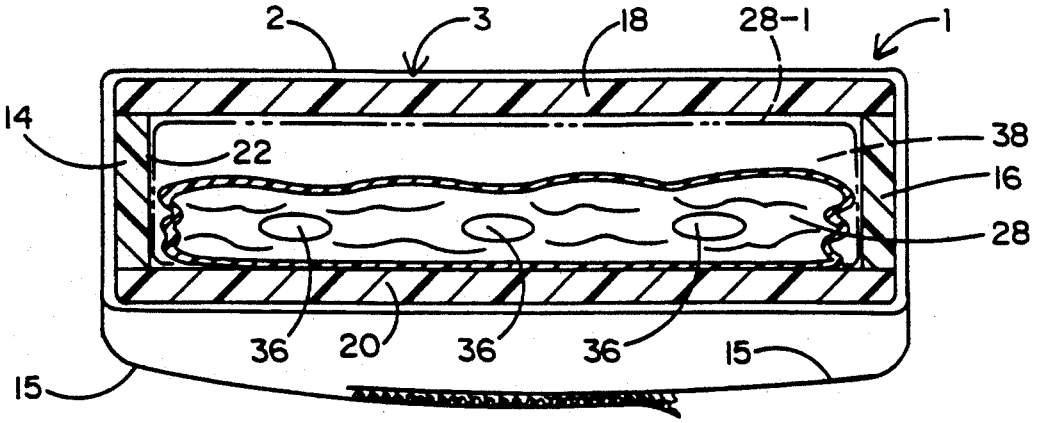
FIG. 5 is a cross-section taken along lines 5—5 of FIG. 1.

FIG. 5 of the drawings shows the normally uninflated air plenum 28 located within the hollow compartment 22 of mattress 3. In such an uninflated condition, an airspace 38 is created having a liner dimension of approximately 3–5 inches between the top of plenum 28 and the top support surface 18 of mattress 3. In this case, an individual (not shown) resting upon the top support surface 18 of mattress 3 will sink slightly towards the uninflated air plenum 28 to thereby compress the air space 38. Thus, it may be said that the individual initially lies in the mattress and not on it as with conventional hospital mattresses. However, and as will be disclosed when referring to FIG. 7, when the air plenum is inflated (shown in phantom lines in FIG. 5 and represented by the reference numeral 28-1), the former air space 38 will be eliminated and the individual will be lifted upwardly and supported at the top surface 18 by means of the air pressure within plenum 28.

Figure 6:
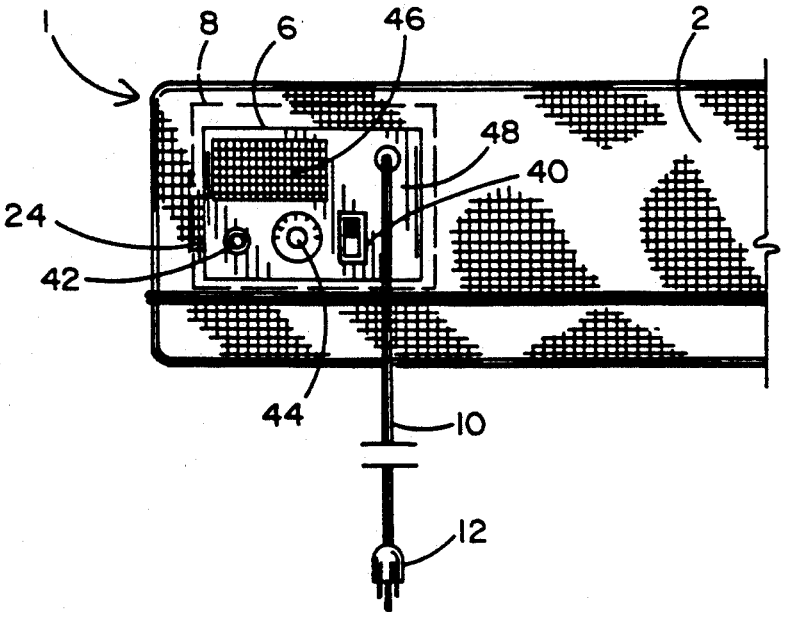
FIG. 6 is an enlarged detail taken from FIG. 1.

FIG. 6 of the drawings shows the front of the blower housing 24 and the control panel 48 located thereat and accessible through the windows 6 and 8 formed in the outer liner 2 and mattress 3, respectively. That is, the health care worker or care giver may operate the control panel 28 at blower housing 24 to control the rate at which the air plenum 28 of FIG. 5 is filled with air. More particularly, the control panel 48 of housing 24 includes and on-off power switch 40 by which to control the supply of power to the soon to be described motor driven blower 50 at the interior of blower housing 24 via power cord 10. The on-off switch 40 may have a conventional LED or LCD associated therewith to provide a visual indication of the disposition of power switch 40. The control panel 48 also has a reset button 42 to enable the blower 50 to operate after an overload condition has been sensed and corrected. A pressure control knob 44 is provided at panel 48 to enable the health care worker or care giver to selectively vary the rate at which the air plenum 28 is filled with air. That is, by rotating pressure control knob 44, the speed of the motor 52 of blower 50 can be controlled so as to vary the volume of air discharged by blower 50 and the corresponding air pressure supplied to plenum 28. In this way, the therapy applied to the individual can be selectively tailored to accommodate his particular needs. An air intake (e.g activated charcoal) filter 46 is also located at the control panel 48 of blower housing 24 to remove odors from and filter intake air to blower 50.

FIG. 7 of the drawings, shows the interior of the blower housing 24. More particularly, the blower 50 is a fan that is driven by a brushless DC motor 52. By way of example, blower 50 and motor 52 are arranged in a common casing and comprise a centrifugal two stage fan and variable speed electric motor such as that which is commercially available as model number B/LAC from the Lamb Electric Division of Ametek Corporation. The motor 52 is electrically connected to a conventional 10 volt DC control unit 54 by which the speed of motor 52 can be adjusted depending upon the setting of pressure control knob 44 at the control panel 48 of blower housing 24. The advantage of controlling the speed of motor 52 and the output of blower 50 were previously described when referring to FIG. 6.

Also located within blower housing 24 is a wire distribution panel 56 from which electrical wires which carry power provided by power cord 10 are routed to the motor 52 and speed control unit 54. To reduce the ambient noise level as a consequence of blower 50 pulling in air from the atmosphere, a series of intake baffles 58 are positioned between the motor driven fan 50 and the control panel 48 at which air intake filter 46 is located. Baffles 58 are preferably aluminum plates that are alternatively attached (e.g. welded) to the top and bottom of blower housing 24.

A flexible air tube 30 (also shown in FIG. 4) extends between the blower 50 and air plenum 28 of the mattress system 1 so that a selectively controlled volume of air can be exhausted from blower 50 to the air chambers (designated 32 in FIG. 4) of plenum 28 to pressurize said plenum according to the needs of the individual. To this end, a conventional coupler 60 is connected between air tube 30 and an air intake port 62 at the first of the plenum chambers 32 to receive the air exhausted from motor driven blower 50.

By virtue of the present invention, the air plenum, air tubes, electrical wires and controls, and motor driven blower are part of an integral, relatively low cost and easily portable mattress system 1 that is conveniently and efficiently contained in and transported with the mattress 3. That is to say, mattress system 1 is fully self-contained and requires no external connections or operating systems. This avoids the external blower, control, inflation and interconnection systems, as well as the space consumption and inconvenience associated with conventional low air loss mattress systems. What is more, the low air loss mattress system 1 of the present invention may be easily operated and requires no special storage facility when not in use, making it ideal as a replacement for the conventional hard mattresses common to hospitals and similar health care facilities which receive non-ambulatory individuals.

While a preferred embodiment of this invention has been shown and described, various modifications and changes may be made without departing from the true spirit and scope of the invention. For example, the presently disclosed mattress system 1 may be used on any flat surface such as a floor at home or a frame of a hospital bed, or the like. However, it is to be expressly understood that this invention is not limited to replacing a conventional mattress in a health care environment. The mattress herein disclosed and the advantageous characteristics thereof may also be used to replace the common waterbed mattress so as to avoid the inherent problems associated with filling and transporting such mattress.

I claim:

1. An inflatable mattress system comprising:
a mattress;
a hollow compartment at the interior of said mattress;
an inflatable air plenum located within said hollow compartment, said air plenum including a plurality of air chambers adapted to be filled with air to enable said plenum to provide support for an individual laying on the mattress and each of said air chambers having means by which to permit air to leak out of said plenum; and
a blower located within said hollow compartment and coupled to said air plenum to exhaust air for inflating said plenum at the same time that air is leaked from said plenum.

2. The mattress system recited in claim 1, wherein each of said plurality of air chambers is separated from one another by respective end walls, each of said end walls having at least one air hole formed therein to permit said air chambers to communicate with one another.

3. The mattress system recited in claim 1, wherein each of said plurality of air chambers is surrounded by and stitched to said air plenum, the air leakage from said chambers occurring at said stitching.

4. The mattress system recited in claim 1, further comprising a variable speed electric motor located within the hollow compartment of said mattress to drive said blower.

5. The mattress system recited in claim 4, further comprising adjustable pressure control means electrically connected to said blower motor for varying the speed of said motor and the rate at which air is exhausted by said blower to inflate said air plenum.

6. The mattress system recited in claim 5, further comprising a blower housing located within the hollow compartment of said mattress adjacent said inflatable air plenum, said blower and said blower motor located in said housing.

7. The mattress system recited in claim 6, further comprising fluid tubing extending through said blower housing between said blower and said inflatable air plenum so that air exhausted by said blower is delivered to said plenum by way of said fluid tubing.

8. The mattress system recited in claim 6, further comprising noise baffles located within said blower housing to dampen the noise caused by operation of said blower.

9. The mattress system recited in claim 6, further comprising a control panel at one end of said blower housing and a window cut through said mattress and aligned with said blower housing to permit manual access to the control panel thereof, said pressure control means located at said control panel.

10. The mattress system recited in claim 1, wherein said mattress is formed by a pair of opposing side layers and a pair of opposing top and bottom layers, said top, bottom and side layers connected together so as to form said hollow compartment therebetween for receiving said inflatable air plenum.

11. The mattress system recited in claim 10, wherein each of said top, bottom and side layers is manufactured from an open cell foam material.

12. An inflatable mattress system comprising:
a mattress;
a hollow compartment at the interior of said mattress;
an inflatable air plenum located within said hollow compartment, said plenum adapted to be filled with air to provide pressure for supporting an individual laying on the mattress and said plenum having means by which to permit air to continuously leak therefrom;
a blower coupled to said air plenum and operable to continuously exhaust air for inflating said plenum at the same time that air is leaked from said plenum;
an electric motor for driving said blower; and
adjustable speed control means electrically connected to said electric motor to selectively control the speed of said motor between maximum and minimum speeds and thereby vary the rate at which air is exhausted by said blower to inflate said inflatable air plenum such that the pressure provided by said air plenum is correspondingly variable depending upon the rate at which air is simultaneously exhausted from said blower and leaked from said plenum.

13. The mattress system recited in claim 12 further comprising a blower housing located within said hollow compartment adjacent said air plenum, said blower and said blower motor located within said blower housing and said speed control means positioned at a manually accessible location on said blower housing.

14. The mattress system recited in claim 13, further comprising a control panel at one end of said blower housing and a window cut through said mattress and aligned with said blower housing to permit manual access to the control panel thereof, said speed control means located at said control panel.

15. The mattress system recited in claim 12, wherein said inflatable air plenum includes a plurality of inflatable air chambers coupled to said blower to be continuously filled with air exhausted from said blower.

16. The mattress system recited in claim 15, wherein each of said plurality of air chambers is surrounded by and affixed to said air plenum by means of stitching, such that air continuously leaks from said plenum at said stitching.

17. The mattress system recited in claim 12, wherein said inflatable air plenum, said blower and said blower motor are all located within said hollow compartment at the interior of said mattress.

18. A fully self-contained, inflatable mattress system comprising:

a mattress having top, bottom and side walls connected together to form a hollow compartment at the interior of said mattress;

an inflatable air plenum adapted to be filled with air to provide pressure for supporting an individual laying on said mattress;

a blower coupled to said air plenum to exhaust air for inflating said air plenum;

fluid tubing extending between said blower and said air plenum so that air exhausted by said blower is delivered to said plenum;

a blower motor for driving said blower;

a blower housing surrounding at least said blower motor and having a control panel located at one end thereof; and pressure control means electrically connected to said blower motor to control the speed of said motor and the rate at which air is exhausted to said inflatable air plenum, said pressure control means located at said control panel;

each of said air plenum, said blower, said blower housing, said fluid tubing and said blower motor located entirely within said hollow compartment at the interior of said mattress, and one of said top, bottom or side walls of said mattress having a window cut therethrough and aligned with said blower housing to permit manual access to said control panel and said pressure control means located thereat.

* * * * *